US005852980A

United States Patent [19]

Hance

[11] Patent Number: 5,852,980

[45] Date of Patent: Dec. 29, 1998

[54] FUEL DISPENSER PALLET DEVICE

[75] Inventor: Michael R. Hance, Bonham, Tex.

[73] Assignee: Schlumberger Industries, Inc., Norcross, Ga.

[21] Appl. No.: 855,619

[22] Filed: May 13, 1997

[51] Int. Cl.[6] ..... B65D 19/44

[52] U.S. Cl. ..... 108/55.3; 108/56.3; 108/57.32

[58] Field of Search ..... 108/55.3, 55.1, 108/56.3, 57.32, 56.1

[56] References Cited

U.S. PATENT DOCUMENTS

| | | | |
|---|---|---|---|
| 1,832,759 | 11/1931 | Bennett | 108/57.32 X |
| 3,962,660 | 6/1976 | Duckett | 108/55.3 X |
| 4,079,907 | 3/1978 | Mykleby | 108/56.1 X |
| 4,169,417 | 10/1979 | Gemvik | 108/56.3 |
| 4,274,540 | 6/1981 | Coles et al. | 108/56.3 X |
| 4,350,099 | 9/1982 | Persson | 108/56.1 |
| 4,445,614 | 5/1984 | Mitsumori et al. | 108/56.3 X |
| 5,180,134 | 1/1993 | Mallak | 108/55.1 X |
| 5,507,237 | 4/1996 | Barrow et al. | 108/55.1 |
| 5,588,372 | 12/1996 | Kelley | 108/55.1 |
| 5,664,394 | 9/1997 | Sweeney | 108/56.3 X |
| 5,676,063 | 10/1997 | Wallace | 108/55.3 X |
| 5,722,328 | 3/1998 | Darby | 108/55.1 |

FOREIGN PATENT DOCUMENTS

| | | | |
|---|---|---|---|
| 2026431 | 2/1980 | United Kingdom | 108/56.3 |

*Primary Examiner*—Peter M. Guomo
*Assistant Examiner*—Hank V. Tran
*Attorney, Agent, or Firm*—Dority & Manning, P.A.

[57] ABSTRACT

A pallet device for supporting a fuel dispenser or other movable object comprises a pair of runner elements mounted in parallel and spaced apart relation. Each runner element defines a respective longitudinal channel, which together permit endwise insertion of lifting forks. A pair of side ports extend laterally from the longitudinal channel of each runner element. The respective side ports of the two runner elements are aligned to provide transverse channels for sidewise insertion of lifting forks. Preferably, the two runner elements are made from sheet metal components for consistent and lightweight construction.

17 Claims, 3 Drawing Sheets

FUEL DISPENSER PALLET DEVICE

BACKGROUND OF THE INVENTION

The present invention relates generally to the transport of fuel dispensers from a manufacturing facility to an installation location. More particularly, the invention relates to an improved pallet for supporting a fuel dispenser and facilitating the transport thereof.

Typically, a pallet is attached to the bottom of a fuel dispenser at the time the dispenser is manufactured. In addition to supporting the dispenser above the floor, the pallet permits insertion of lifting forks, such as those of a forklift or pallet truck. As a result, the dispenser may be lifted, such as for testing or loading purposes. The pallet remains attached to the fuel dispenser during shipment, and is removed at the installation location.

In the past, pallets utilized during transport of fuel dispensers have generally been made of wood. As will be described in detail below, however, wooden pallets have a number of disadvantages. Accordingly, a need exists in the art for an improved pallet device that overcomes the various disadvantages of wooden pallets used with fuel dispensers.

SUMMARY OF THE INVENTION

The present invention recognizes and addresses various disadvantages of prior art constructions and methods. Accordingly, it is an object of the present invention to provide an improved pallet device.

It is a more particular object of the present invention to provide an improved pallet device for use with a fuel dispenser apparatus.

It is also an object of the present invention to provide a reusable metal pallet.

It is a further object of the present invention to provide a two-element pallet that achieves a relatively small size when not installed on a supported object.

It is a further object of the present invention to provide a two-element pallet in which the respective elements thereof are spaced apart when installed on a supported object.

It is also an object of the present invention to provide a pallet device that can be accessed by lifting forks from four sides.

Some of these objects are achieved by a pallet device for supporting a fuel dispenser and facilitating the transport thereof. The pallet device comprises a first runner element adapted to be attached to a bottom of the fuel dispenser apparatus. The first runner element defines a first longitudinal channel having a first predetermined width and height. The pallet device further comprises a second runner element adapted to be attached to the bottom of the fuel dispenser apparatus generally in parallel with the first runner element. The second runner element defines a second longitudinal channel having a second predetermined width and height.

In some exemplary embodiments, the runner elements are constructed substantially entirely of metal and comprise a generally planar top portion. A plurality of generally U-shaped channel members, e.g. three channels members, preferably depend from the top portion to define a respective longitudinal channel. The generally planar top portions of each runner element may also define a plurality of mounting holes therein.

Each of the runner elements may also define a pair of side ports. In this case, the runner elements are preferably adapted to be attached to the bottom of the fuel dispenser apparatus such that respective side ports of the first runner element are aligned with respective side ports of the second runner element. Preferably, side ports of the first runner element and the second runner element laterally extend from the first longitudinal channel and the second longitudinal channel, respectively.

In some such embodiments, the runner elements each comprise a generally planar top portion having a longitudinal runner top with a pair of side port tops extending laterally therefrom. A plurality of generally U-shaped channel members preferably depend from the top portion to define the sides ports and a respective longitudinal channel. Respective U-shaped channel members associated with the side ports are preferably inclined from a wider portion adjacent the top portion to a narrower portion distal from the top portion.

Other objects of the invention are achieved by a combination including a movable object having a generally planar bottom. The movable object is supported by a pallet device attached to the bottom of the movable object. The pallet further defines two parallel first fork channels running across the pallet device in a first direction and two parallel second fork channels running across the pallet device in a second direction. The first direction is substantially transverse to the second direction.

In some exemplary embodiments, the pallet device is constructed as a pair of runner elements attached to the bottom of the movable object in a predetermined orientation. For example, the pair of runner elements may be attached to the bottom of the movable object in parallel and spaced apart relation.

Preferably, the runner elements may each comprise a longitudinal channel from which a pair of side ports laterally extend. Toward this end, the runner elements may each comprise a generally planar top portion having a longitudinal runner top with a pair of side port tops extending laterally therefrom. A plurality of generally U-shaped channel members may be provided, depending from the top portion to define the side ports and a respective longitudinal channel.

Still further objects of the present invention are achieved by a pallet device for supporting a fuel dispenser and facilitating the transport thereof. The pallet device comprises first and second runner elements constructed substantially entirely of metal. The runner elements are adapted to be attached to a bottom of the fuel dispenser apparatus in parallel and spaced apart relation. Each of the runner elements defines a longitudinal channel and a pair of side ports extending laterally therefrom. In this regard, side ports of the first runner element are oppositely directed from and generally aligned with side ports of the second runner element.

Other objects, features and aspects of the present invention are provided by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
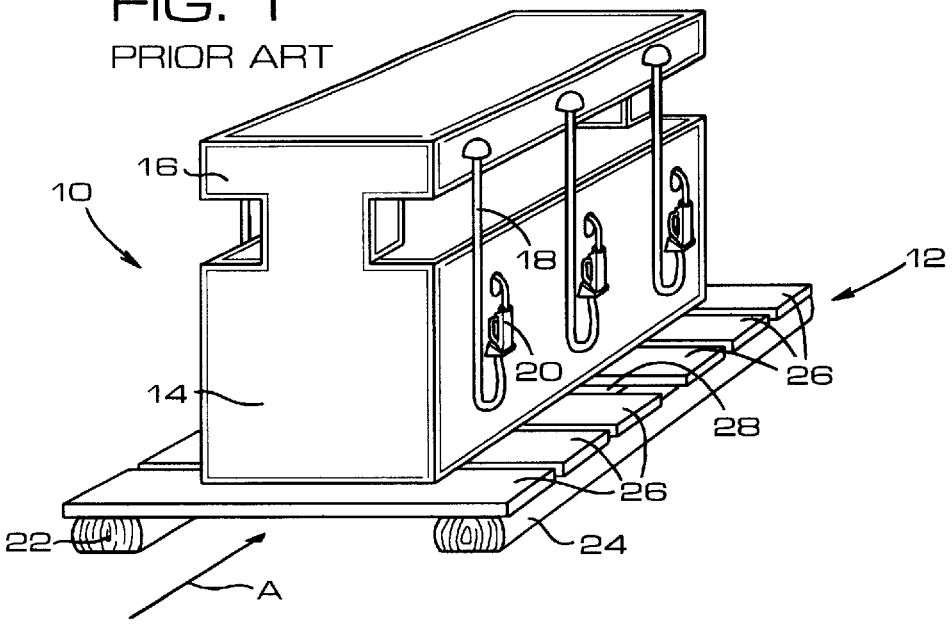
FIG. 1 PRIOR ART
FIG. 1 is a perspective view of a fuel dispenser apparatus mounted to a wooden pallet of the prior art.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

In order to place various aspects of the present invention in context, the prior art will first be described in greater detail. Thus, FIG. 1 illustrates a prior art arrangement in which a fuel dispenser 10 is mounted to a wooden pallet 12. In this case, dispenser 10 is the common type having a base portion 14 above which a canopy 16 is erected. A plurality of fuel hoses, such as hose 18, depend from canopy 16 as shown. The fuel hoses provide fluid communication between fuel conduits within dispenser 10 and a respective nozzle, such as nozzle 20.

As shown, pallet 12 includes a pair of runner beams 22 and 24 extending in parallel to the main longitudinal dimension of base portion 14. A plurality of cross beams 26 are attached to the upper surface of runner beams 22 and 24, typically utilizing screw nails or the like. Multiple attachment bolts extend through holes in cross beams 26 to attach pallet 12 to the bottom of base portion 14.

Lifting forks may be inserted from either end into the region between cross beams 22 and 24, as indicated by arrow A. Once in position, the lifting forks are raised against the bottom of cross beams 26 to lift pallet 12. As a result, dispenser 10 may be easily moved about for various purposes. For example, dispenser 10 may be loaded onto a common carrier trailer, or other shipping container.

Typically, dispenser 10 is tested during the manufacturing process after pallet 12 has been attached. Toward this end, cross beams 26 are generally spaced to yield one or more gaps, such as gap 28. These gaps allow connection of test equipment during the manufacturing process. While all of cross beams 26 are shown as being of approximately the same size, it should be realized that such may not always be the case. For example, beams of various widths may be appropriately spaced to yield the desired gaps.

In a typical construction, the "footprint" of pallet 12 is approximately 38×60 inches. The vertical height of pallet 12 has generally been restricted to no more than approximately five inches. This is due to overall height limitations imposed by common carriers in view of the height inevitably contributed by dispenser 10. As a result, beams 22 and 24 have often had a vertical height of about 3.5 inches, with the height of cross beams 26 being approximately 1.5 inches. Typically, pallet 12 is constructed of hardwood, such as oak.

While pallet 12 has generally been effective for its intended purpose, it is not without disadvantages. For example, cross beams 22 and 24 are solid, thus preventing insertion of lifting forks from the sides. As a result, it is relatively difficult when using pallet 12 to load dispenser 10 onto a shipping container in a sideways orientation. Such a sideways orientation is often desirable, however, because it may allow more dispensers to be loaded onto the container than would otherwise be the case.

It can also be seen that pallet 12 does not have cross beams on the bottom, thus making dispenser 10 susceptible to tipping when raised on the lifting forks. In addition, cross beams 26 on the top are required to support the entire weight of dispenser 10. As such, cross beams 26 will often have a tendency to break. This is especially true if pallet 12 is lowered quickly, or if the shipping container into which pallet 12 has been loaded is subjected to excessive movement during transport. The wooden construction of pallet 12 also has a tendency to transmit shock or vibration, instead of absorbing or dissipating it.

Pallets such as pallet 12 may typically weigh in excess of 120 pounds. As a result, a hoist will often be required to move and attach the pallet to a dispenser. The configuration of the pallet as a one piece body also makes it bulky to store. Due to these size and weight factors, the pallets are rarely reused once removed from the dispenser at the installation location. Warpage and other factors attendant to the use of wood also give rise to various quality control concerns, such as problems in the alignment of mounting holes.

Figure 2:
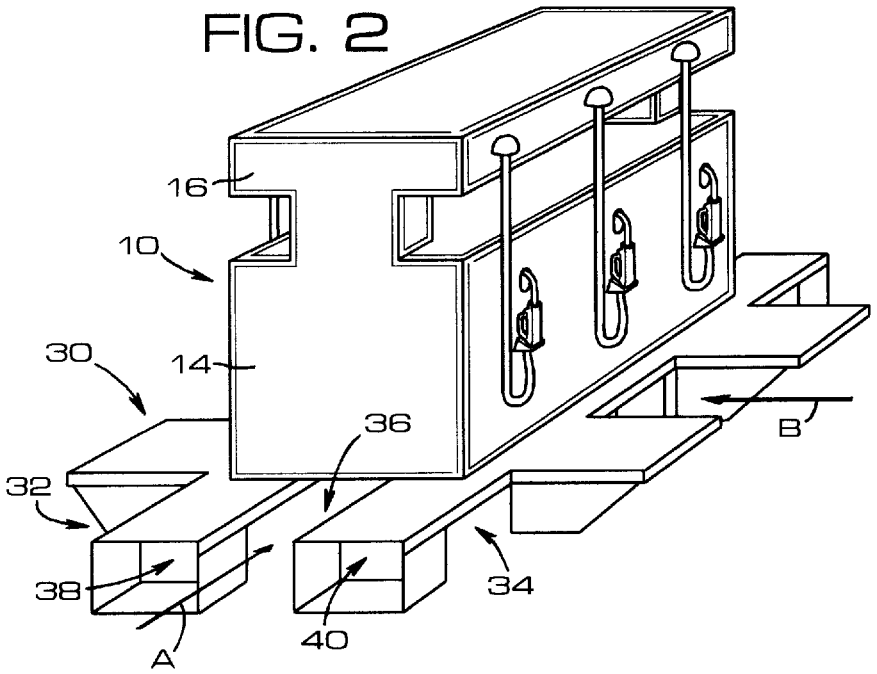
FIG. 2 is a perspective view of a fuel dispenser apparatus mounted to a pallet device of the present invention.
Figure 3:
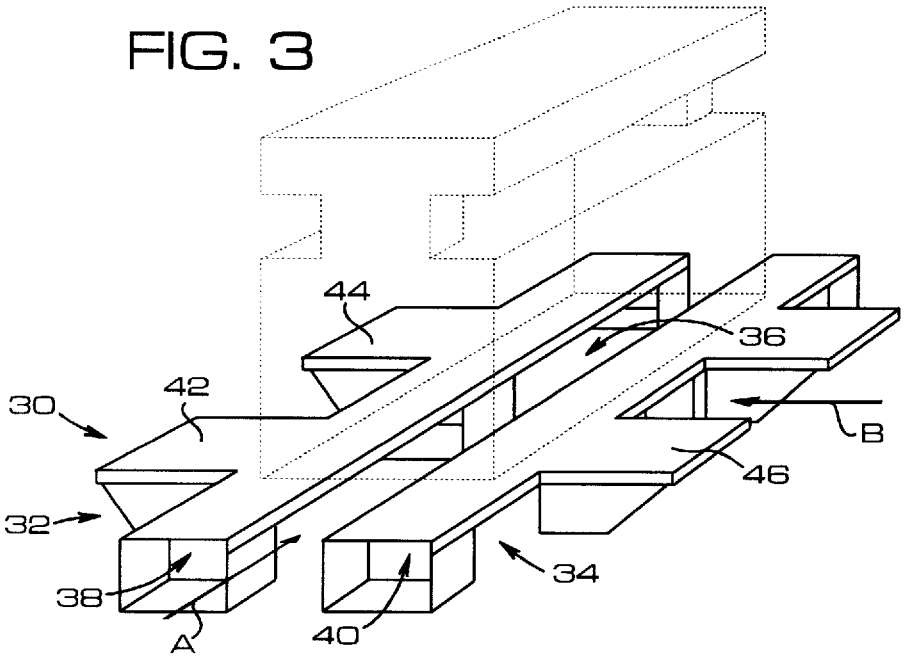
FIG. 3 is a view similar to FIG. 2 showing the fuel dispenser in phantom to expose further details of the pallet device.

FIGS. 2 and 3 illustrate a pallet 30 of the present invention which overcomes the various disadvantages of pallet 12. Pallet 30 comprises a pair of runner elements 32 and 34 attached to the bottom of base portion 14 in parallel and spaced apart relation. In one exemplary embodiment, the "footprint" of pallet 30 is approximately 52×42 inches.

Unlike prior art pallet 12, it can be seen that the primary supporting structure of pallet 30 is directly under dispenser 10. In other words, pallet 30 does not utilize spanning cross beams which may have a tendency to break as described above. The two-piece construction, however, advantageously provides a gap 36 that facilitates connection of test equipment to the underside of dispenser 10.

Like pallet 12, lifting forks may be inserted from either end of pallet 30 (as indicated by arrow A). In this regard, runner elements 32 and 34 define respective longitudinal channels 38 and 40 extending along their length. One of the respective fork members is received in each of channels 38 and 40. Dispenser 10 may thus be lifted as the lifting forks are raised.

Unlike pallet 12, however, lifting forks may also be inserted from either side of pallet 30 (as indicated by arrow B). Toward this end, runner element 32 defines a pair of side ports 42 and 44 extending laterally from longitudinal channel 38. Runner element 34 defines side ports 46 and 48 situated in alignment with side ports 42 and 44, respectively. A pair of fork channels are thus desirably formed in the transverse dimension.

In presently preferred embodiments, runner elements 32 and 34 are manufactured from sheet metal that has been bent or otherwise formed into the appropriate component parts. For example, a 12 gauge (0.105 thick) cold roll steel is believed suitable for this purpose. The component parts of each runner element are preferably welded together, such as by a mig welder device.

The configuration of pallet 30 and the preferred materials from which it is made will generally result in a relatively light pallet. For example, in one exemplary embodiment, each runner element will weigh approximately twenty pounds, yielding a total pallet weight of about forty pounds. This lighter weight, as well as the two piece construction of pallet 30, provides many advantages in comparison with prior art pallet 12.

For example, the lighter weight of pallet 30 provides a significant cumulative impact on freight costs. In addition, space required to store the pallet when not in use is relatively small. Assembly of the pallet onto the dispenser is relatively quick and easy. The pallet is also easily reusable, resulting in a cost and ecological benefit. In addition, pallet 30 will often absorb shock that would otherwise be transmitted to dispenser 10 more readily than pallet 12.

Referring now to FIGS. 4–7, the construction of runner element 32 will now be described in detail. For the sake of brevity, the construction of runner element 34 will not be described to the same extent. It will be appreciated, however, that runner elements 32 and 34 are preferably constructed in a similar manner.

As can be seen, runner element 32 includes a generally planar top portion 50 having a longitudinal runner top 52. A pair of side port tops 54 and 56 extend laterally from runner top 52 as shown. A peripheral lip, such as lip 58, is preferably provided along the longitudinal sides of runner top 52, as well as side port tops 54 and 56.

As shown, runner top 52 defines a plurality of mounting holes, such as holes 60, to facilitate mounting of runner element 32 to the bottom of the fuel dispenser. Bolts, such as bolts 62, will typically extend through the respective mounting holes. Multiple sets of mounting holes may be provided, whereby a respective set is utilized with a particular dispenser model. It will be appreciated that alignment of the mounting holes in pallet 30 is relatively precise in relation to a wooden pallet of the prior art.

A trio of generally U-shaped members 64*a–c* depend from runner top 52 to define the predetermined width and height of longitudinal channel 38. U-shaped members 66 and 68 depend from respective side port tops 54 and 56. The U-shaped members perform as a stop in the event the load tries to tip in any direction.

Unlike U-shaped members 64*a–c,* U-shaped members 66 and 68 are inclined (as indicated at 70 and 72) in the direction away from top portion 50. This "cut-out" allows wheels of a pallet jack to extend without binding.

In some exemplary embodiments, the fork channels may each have a width and height of approximately eight inches and six inches, respectively. It will be appreciated that the use of metal components allows these and other dimensions of pallet 12 to be closely controlled. As such, "wasted" space in the shipping container can be minimized.

Figure 4:
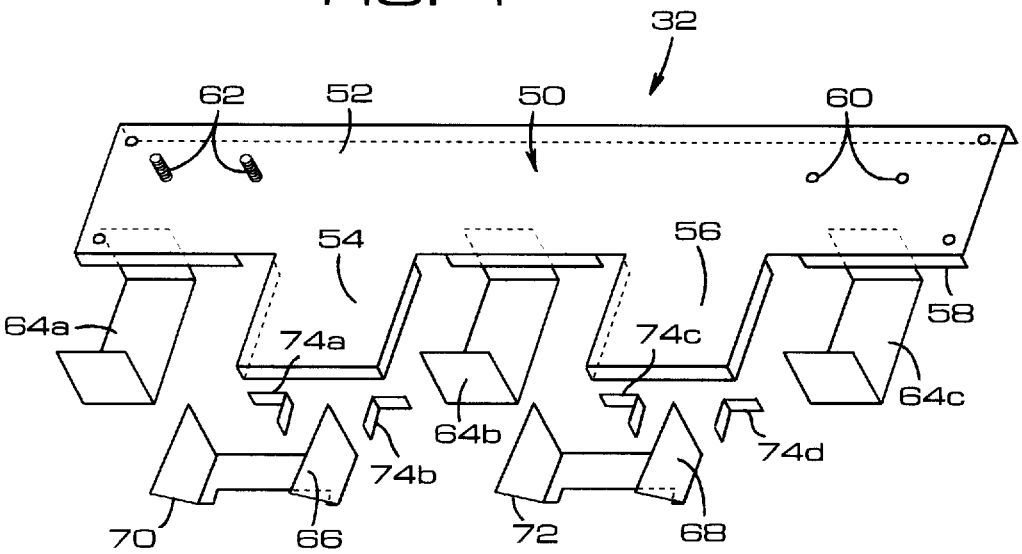
FIG. 4 is an exploded view of a single runner element utilized in the pallet device of FIGS. 2 and 3.
Figure 5:
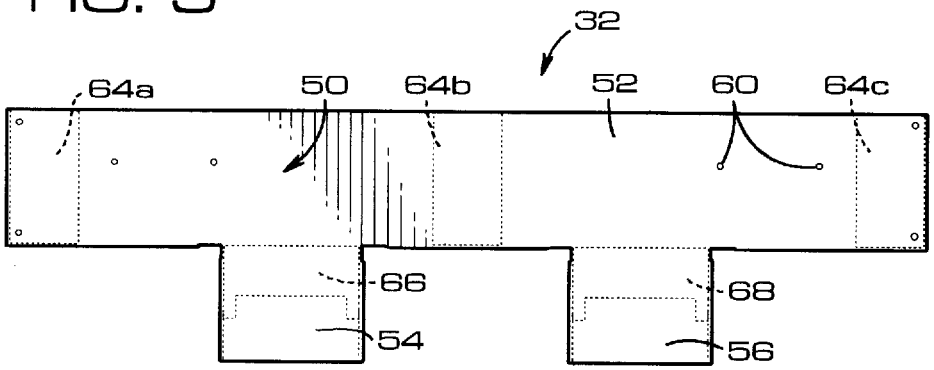
FIG. 5 is a plan view of the runner element.
Figure 6:
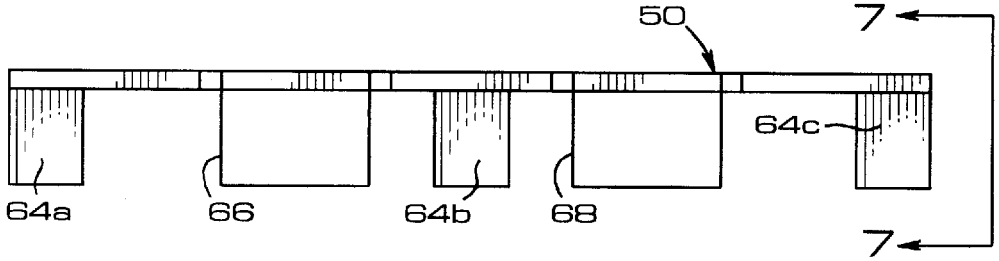
FIG. 6 is a side elevation of the runner element.
Figure 7:
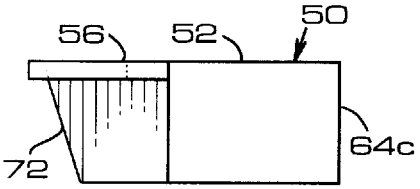
FIG. 7 is an end view of the runner element along line 7—7 of FIG. 6.
Figure 8:
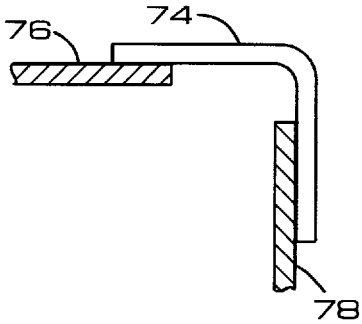
FIG. 8 is an enlarged view showing a corner brace as used at selective positions in the runner element.

FIG. 8 illustrates a corner brace 74 provided to stiffen the region at which one of side ports 42 and 44 extends from longitudinal channel 38. Toward this end, brace 74 is attached to the inside surface of depending lips 76 and 78. Each runner element preferably has four such braces, such as braces 74*a–d* of runner element 32 (FIG. 4). Notwithstanding these stiffeners, the side ports will often flex slightly under load, thus having a tendency to desirably "cradle" the dispenser.

It can thus be seen that the present invention provides an improved pallet device for use in supporting fuel dispensers and other movable objects. While preferred embodiments of the invention have been shown and described, modifications and variations made be made thereto by those of ordinary skill in the art without departing from the spirit and scope of the present invention, which is more particularly set forth in the appended claims. In addition, it should be understood that various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A pallet device for supporting a fuel dispenser and facilitating the transport thereof, said pallet device comprising:

a first runner element adapted to be attached to a bottom of said fuel dispenser apparatus and defining a first longitudinal channel having a first predetermined width and height;

a second runner element adapted to be attached to said bottom of said fuel dispenser apparatus generally in parallel with said first runner element, said second runner element defining a second longitudinal channel having a second predetermined width and height;

each of said first and second runner elements defining a pair of side ports wherein respective side ports of said first runner element are operatively aligned with respective side ports of said second runner element; and further wherein said first and second runner elements each comprise a generally planar top portion having a longitudinal runner top with a pair of side port tops extending laterally therefrom.

2. A pallet device as set forth in claim 1, wherein said first and second runner elements are constructed substantially entirely of metal.

3. A pallet device as set forth in claim 1, wherein generally planar top portions of each of said first and second runner elements have a plurality of mounting holes therein.

4. A pallet device as set forth in claim 1, wherein said side ports of said first runner element and said second runner element laterally extend from said first longitudinal channel and said second longitudinal channel, respectively.

5. A pallet device as set forth in claim 1, wherein a plurality of generally U-shaped channel members depend from said top portion to define said side ports and a respective longitudinal channel.

6. A pallet device as set forth in claim 5, wherein respective of said U-shaped channel members associated with said side ports are inclined from a wider portion adjacent said top portion to a narrower portion distal from said top portion.

7. A combination comprising:

a movable object having a generally planar bottom;

a pallet device attached to said bottom of said movable object to support same;

said pallet device further defining two parallel first fork channels running across said pallet device in a first direction and two parallel second fork channels running across said pallet device in a second direction, said first direction being substantially transverse to said second direction; and wherein said pallet device is constructed as a pair of runner elements attached to said bottom of said movable object in a predetermined orientation, said predetermined orientation being parallel and spaced apart relation.

8. A combination as set forth in claim 7, wherein said pallet device is constructed substantially entirely of metal.

9. A combination as set forth in claim 7, wherein said pallet device is attached to said object utilizing a plurality of bolts.

10. A combination comprising:

a movable object having a generally planar bottom;

a pallet device attached to said bottom of said movable object to support same;

said pallet device further defining two parallel first fork channels running across said pallet device in a first direction and two parallel second fork channels running across said pallet device in a second direction, said first direction being substantially transverse to said second direction;

wherein said pallet device is constructed as a pair of runner elements attached to said bottom of said movable object in a predetermined orientation; and further wherein said runner elements each comprise a longitudinal channel from which a pair of side ports laterally extend.

11. A combination as set forth in claim 10, wherein said runner elements each comprise a generally planar top portion having a longitudinal runner top with a pair of side port tops extending laterally therefrom.

12. A combination as set forth in claim 11, wherein a plurality of generally U-shaped channel members depend from said top portion to define said side ports and a respective longitudinal channel.

13. A combination as set forth in claim 10, wherein said pallet device is constructed substantially entirely of metal.

14. A combination as set forth in claim 10, wherein said pallet device is attached to said object utilizing a plurality of bolts.

15. A pallet device for supporting a fuel dispenser and facilitating transport thereof, said pallet device comprising:

first and second runner elements constructed substantially entirely of metal and adapted to be attached to a bottom of said fuel dispenser apparatus in parallel and spaced apart relation;

each of said runners defining a longitudinal channel and a pair of side ports extending laterally therefrom, side ports of said first runner element being oppositely directed from and generally aligned with side ports of said second runner element; and wherein said first and second runner elements each comprise a generally planar top portion having a longitudinal runner top with a pair of side port tops extending laterally therefrom.

16. A pallet device as set forth in claim 15, wherein a plurality of generally U-shaped channel members depend from said top portion to define said side ports and a respective longitudinal channel.

17. A pallet device as set forth in claim 16, wherein respective of said U-shaped channel members associated with said side ports are inclined from a wider portion adjacent said top portion to a narrower portion distal from said top portion.

* * * * *